US010816921B1

(12) United States Patent
Sunohara et al.

(10) Patent No.: US 10,816,921 B1
(45) Date of Patent: Oct. 27, 2020

(54) FIXING APPARATUS AND IMAGE FORMING APPARATUS

(71) Applicant: FUJI XEROX CO., LTD., Tokyo (JP)

(72) Inventors: Tsuyoshi Sunohara, Kanagawa (JP); Nobuyoshi Komatsu, Kanagawa (JP); Yuichiro Saito, Kanagawa (JP); Yasunori Fujimoto, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/749,515

(22) Filed: Jan. 22, 2020

(30) Foreign Application Priority Data

Jul. 24, 2019 (JP) ..... 2019-135996

(51) Int. Cl.
*G03G 15/20* (2006.01)

(52) U.S. Cl.
CPC ..... *G03G 15/2025* (2013.01)

(58) Field of Classification Search
None
See application file for complete search history.

(56) References Cited

U.S. PATENT DOCUMENTS

2005/0163540 A1* 7/2005 Umezawa ..... G03G 15/2064 399/328

FOREIGN PATENT DOCUMENTS

| | | | |
|---|---|---|---|
| JP | 7-295427 | A | 11/1995 |
| JP | 2007-219232 | A | 8/2007 |
| JP | 2013-29581 | A | 2/2013 |

* cited by examiner

*Primary Examiner* — Jas A Sanghera

(74) *Attorney, Agent, or Firm* — Sughrue Mion, PLLC

(57) ABSTRACT

A fixing apparatus includes a heating section including a belt having a layered structure in which a metal layer is held between nonmetal layers. The belt has a front surface that comes into contact with a toner image and a back surface that does not come into contact with the toner image. The belt has a first thickness from the front surface to the metal layer inside the belt and a second thickness from the back surface to the metal layer inside the belt.

The fixing apparatus also includes a pressure section that holds, between the pressure section and the belt, a transported sheet of paper holding the toner image and that applies pressure to the sheet of paper.

The fixing apparatus further includes a first static eliminating section that eliminates static from the belt while being in contact with a surface of the belt. The surface is the front surface or the back surface that is on a side of the first thickness or the second thickness having a smaller thickness when the first thickness and the second thickness are compared.

20 Claims, 6 Drawing Sheets

FIXING APPARATUS AND IMAGE FORMING APPARATUS

CROSS-REFERENCE TO RELATED APPLICATIONS

This application is based on and claims priority under 35 USC 119 from Japanese Patent Application No. 2019-135996 filed Jul. 24, 2019.

BACKGROUND

(i) Technical Field

The present disclosure relates to a fixing apparatus and an image forming apparatus.

(ii) Related Art

Regarding a fixing apparatus that fixes a toner image on a sheet of paper while applying heat and pressure, an electromagnetic induction-type fixing apparatus is known. The fixing apparatus includes a belt having a layered structure in which a metal layer is held between nonmetal layers, and the belt generates heat by electromagnetic induction.

In such a fixing apparatus, an event called electrostatic offset in which a portion of a toner is transferred to the heating section side may occur. When electrostatic offset occurs, a toner image that has been transferred to the heating section side appears at an unintended location on the sheet of paper. Regarding paper, acidic component-containing paper such as in some types of envelopes is commercially available. When such acidic component-containing paper is used, there is an increased possibility that electrostatic offset occurs. Such electrostatic offset tends to be caused by the influence of charging of the heating section.

To suppress electrostatic offset, Japanese Unexamined Patent Application Publication No. 2013-029581 proposes inclusion of an electric potential control apparatus that controls the surface potential of a rotation member for heating and a rotation member for applying pressure.

Moreover, Japanese Unexamined Patent Application Publication No. 2007-219232 proposes providing a heating roller, which heats a fixing belt, with a static eliminating function.

Furthermore, Japanese Unexamined Patent Application Publication No. 7-295427 discloses a configuration in which a static eliminating brush is disposed near a pressure roller.

SUMMARY

Aspects of non-limiting embodiments of the present disclosure relate to a fixing apparatus equipped with a static eliminating unit that eliminates static from a belt having a layered structure including a metal layer by using the metal layer and relate to an image forming apparatus including the fixing apparatus.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing apparatus including:

a heating section including a belt having a layered structure in which a metal layer is held between nonmetal layers, the belt having a front surface that comes into contact with a toner image and a back surface that does not come into contact with the toner image, the belt having a first thickness from the front surface to the metal layer inside the belt and a second thickness from the back surface to the metal layer inside the belt;

a pressure section that holds, between the pressure section and the belt, a transported sheet of paper holding the toner image and that applies pressure to the sheet of paper; and a first static eliminating section that eliminates static from the belt while being in contact with a surface of the belt, the surface being the front surface or the back surface that is on a side of the first thickness or the second thickness having a smaller thickness when the first thickness and the second thickness are compared.

BRIEF DESCRIPTION OF THE DRAWINGS

Exemplary embodiments of the present disclosure will be described in detail based on the following figures, wherein:

FIG. 2 is a schematic view of an inner configuration of the image forming apparatus of which FIG. 1 illustrates the exterior;

DETAILED DESCRIPTION

Hereinafter, exemplary embodiments according to the present disclosure will be described.

Figure 1:
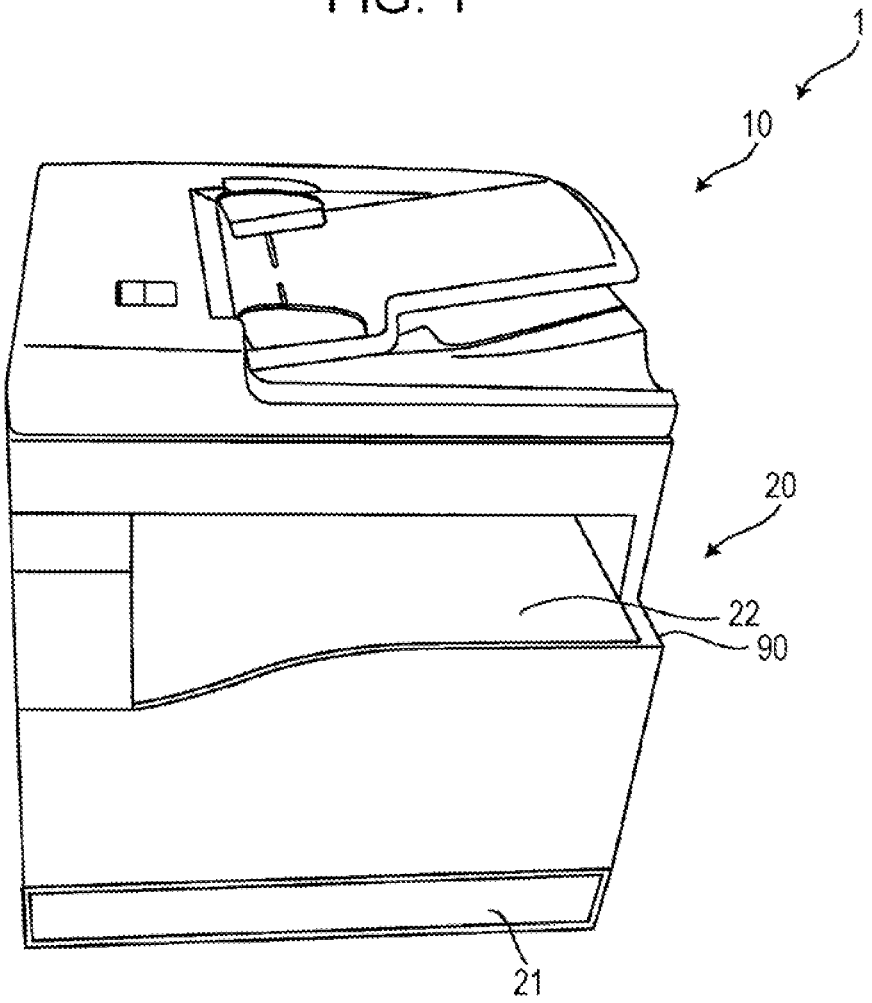
FIG. 1 is an external perspective view of an image forming apparatus as an exemplary embodiment according to the present disclosure.

FIG. 1 is an external perspective view of an image forming apparatus as an exemplary embodiment according to the present disclosure.

An image forming apparatus 1 includes a scanner 10 and a printer 20.

The scanner 10 is disposed on an apparatus housing 90 that is a framework of the image forming apparatus 1, and the printer 20 is configured inside the apparatus housing 90.

Figure 2:
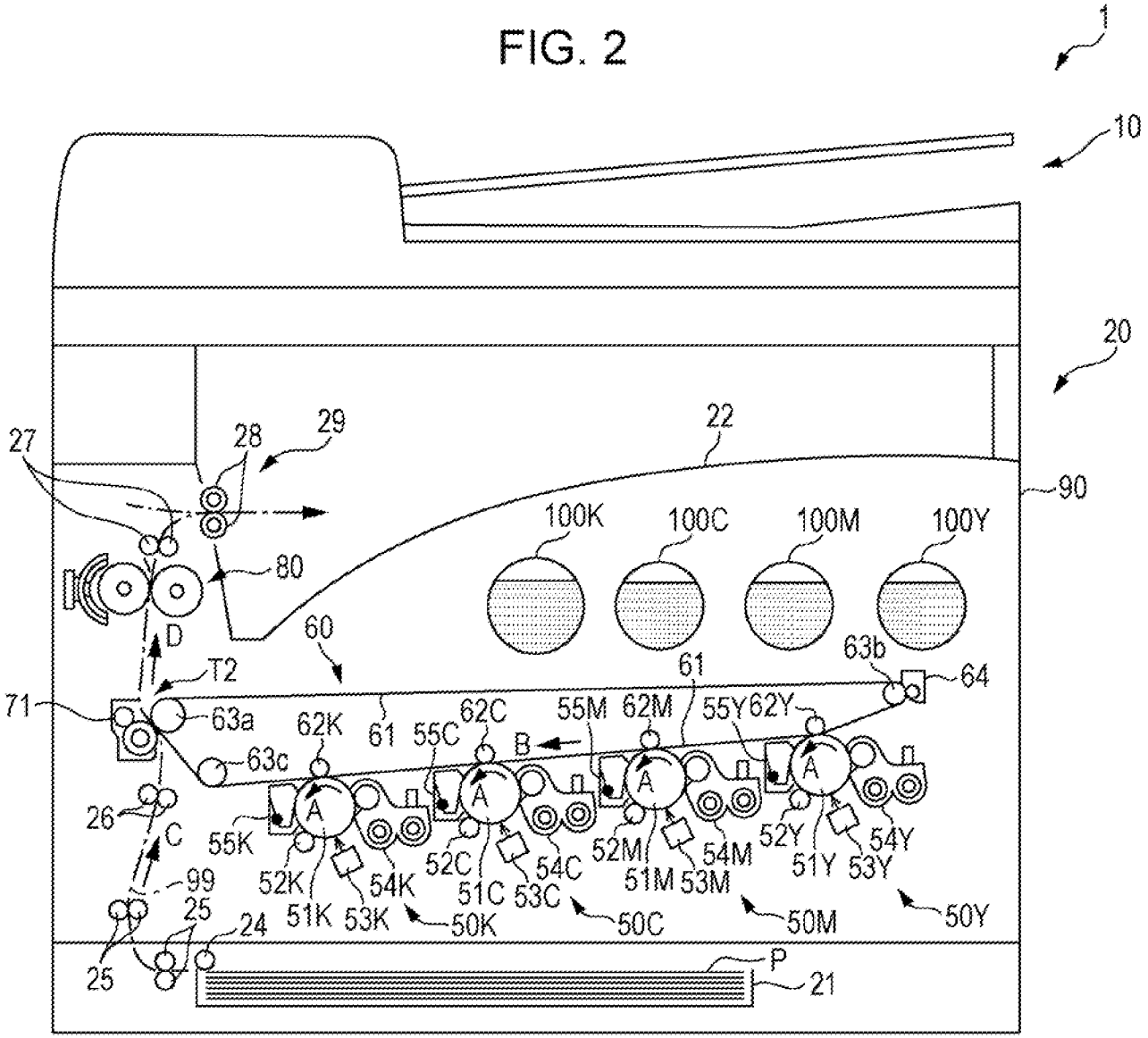

FIG. 2 is a schematic view of an inner configuration of the image forming apparatus of which FIG. 1 illustrates the exterior.

The printer 20 includes four image forming sections 50Y, 50M, 50C, and 50K that are aligned substantially in a row. In each of the image forming sections 50Y, 50M, 50C, and 50K, a toner image formed of a corresponding toner color, that is, yellow (Y), magenta (M), cyan (C), or black (K), is formed. Here, in the description common to the image forming sections 50Y, 50M, 50C, and 50K, references Y, M, C, and K that differentiate the image forming sections from each other by toner color are omitted, and the image forming sections are denoted simply as the image forming sections 50. Other components besides the image forming sections are denoted in a like manner.

Each image forming section 50 includes a corresponding image carrier 51. The image carriers 51 are rotated in the direction indicated by arrows A in response to a driving force. During rotation, an electrostatic latent image is formed on a surface of the corresponding rotating image carrier 51, and a toner image is then formed through development.

Around each of the image carriers 51 included in the image forming sections 50, a charger 52, an exposure device 53, a developing device 54, a first transfer device 62, and a cleaner 55 are provided. Each first transfer device 62 is positioned such that an intermediate transfer belt 61, which will be described later, is placed between the first transfer device 62 and the corresponding image carrier 51. Each first transfer device 62 is a component included in an intermediate transfer section 60, which will be described later, not in the image forming section 50.

Each charger 52 uniformly electrically charges the surface of the corresponding image carrier 51.

Each exposure device 53 forms an electrostatic latent image on the corresponding image carrier 51 by irradiating the uniformly electrically charged image carrier 51 with exposure light that has been modulated in accordance with image signals.

Each developing device 54 contains a developer containing a carrier and a toner of corresponding color of the image forming section 50. In each developing device 54, the electrostatic latent image that has been formed on the corresponding image carrier 51 is developed using a toner of the corresponding color of the image forming section 50, and a toner image is formed on the image carrier 51.

Each first transfer device 62 transfers the toner image that is temporarily held on the corresponding image carrier 51 onto the intermediate transfer belt 61, which will be described later.

Each cleaner 55 removes residual toner or the like that remains, after the transfer, on the corresponding image carrier 51, from the surface of the image carrier 51.

The intermediate transfer section 60 is disposed above the four image forming sections 50. The intermediate transfer section 60 includes the intermediate transfer belt 61. The intermediate transfer belt 61 is supported by plural rollers such as a driving roller 63*a*, a driven roller 63*b*, and a stretching roller 63*c*. The intermediate transfer belt 61 is driven by the driving roller 63*a* and moved in a circulating manner in the direction indicated by arrow B along a circulation path including a path along the four image carriers 51 included in the four image forming sections 50.

Toner images on the respective image carriers 51 are transferred onto the intermediate transfer belt 61 so as to be layered successively by a function of the first transfer devices 62. A toner image that is formed of the toner images, which have been transferred from the image carriers 51, and that is transferred onto the intermediate transfer belt 61 is transported to a second transfer position T2 by the intermediate transfer belt 61. A second transfer device 71 is provided at the second transfer position T2, and the toner image on the intermediate transfer belt 61 is transferred onto a sheet of paper P that has been transported to the second transfer position T2 by a function of the second transfer device 71. Transporting of the sheet of paper P will be described below. Residual toner or the like that remains on the intermediate transfer belt 61 after transfer of the toner image onto the sheet of paper P is removed by a cleaner 64 from the intermediate transfer belt 61.

Toner cartridges 100 containing toners of the respective colors are disposed above the intermediate transfer section 60. When a toner in the corresponding developing device 54 is consumed through development, a toner is supplied from one of the toner cartridges 100 containing a toner of corresponding color through a toner supply path (not illustrated) to the developing device 54. Each toner cartridge 100 is attachable and detachable with respect to the apparatus housing 90 and is detached when emptied. Then, a new toner cartridge 100 is attached.

A pickup roller 24 picks up one of the sheets of paper P from a paper feeding tray 21, and transport rollers 25 transport the sheet of paper P along a transport path 99 in the direction indicated by arrow C to timing adjustment rollers 26. The sheet of paper P that has been transported to the timing adjustment rollers 26 is sent out toward the second transfer position T2 by the timing adjustment rollers 26 so as to reach the second transfer position T2 in accordance with the timing at which the toner image on the intermediate transfer belt 61 reaches the second transfer position T2. By a function of the second transfer device 71, the toner image is transferred from the intermediate transfer belt 61 onto the sheet of paper P that has been sent out by the timing adjustment rollers 26 at the second transfer position T2. The sheet of paper P onto which the toner image has been transferred is transported toward a fixing device 80 disposed above the second transfer device 71, in the direction indicated by arrow D, while being guided by a paper guide (not illustrated).

The toner image on the sheet of paper P that has been transported in the direction indicated by arrow D and has reached the fixing device 80 is subjected to heat and pressure by the fixing device 80, and the toner image is fixed to the sheet of paper P. Thus, an image formed of the fixed toner image is printed on the sheet of paper P. The sheet of paper P to which the fixing device 80 has fixed the toner image is further transported by transport rollers 27 and sent out by paper output rollers 28 onto a paper output tray 22 via a paper output opening 29.

Next, a structure of the fixing device 80 will be described. The fixing device 80 corresponds to an example of a fixing apparatus according to the present disclosure.

Figure 3:
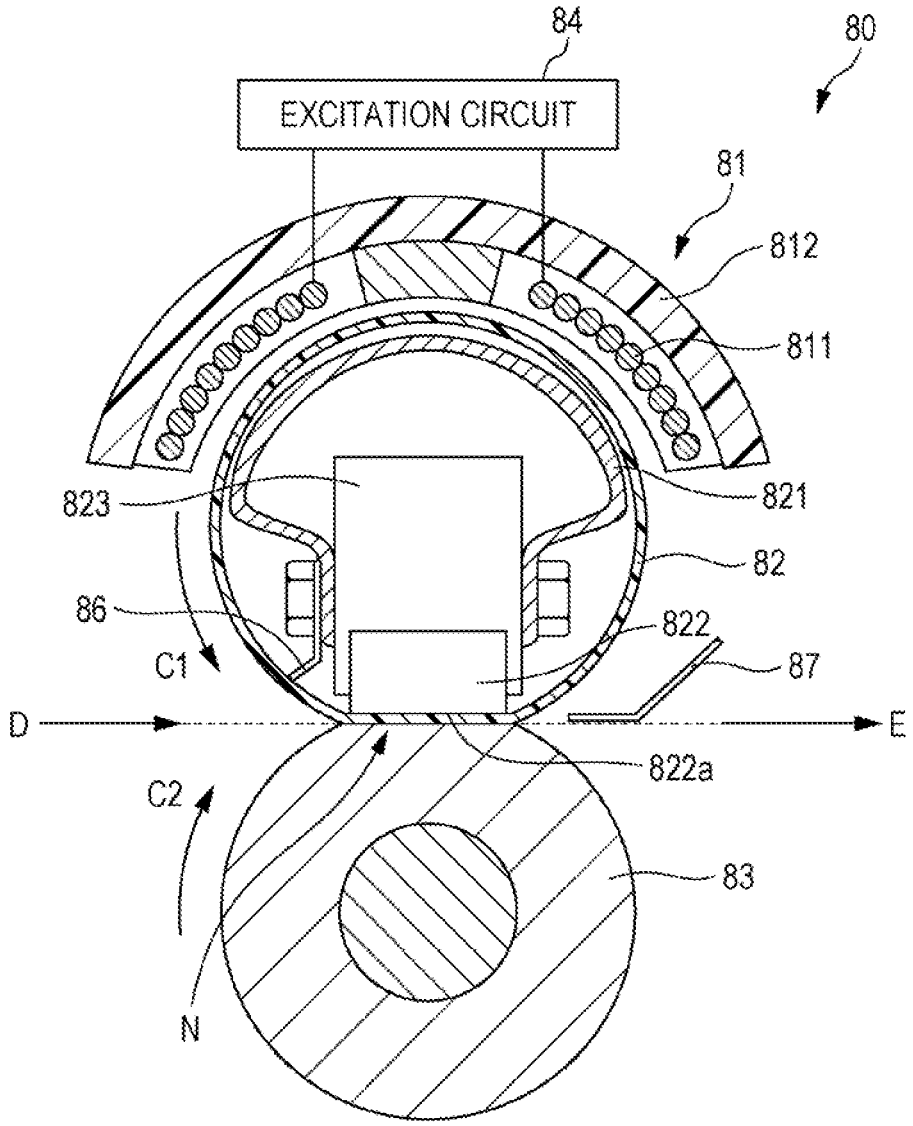
FIG. 3 is a sectional view of a structure of a fixing device.

FIG. 3 is a sectional view of the structure of the fixing device. The fixing device illustrated in FIG. 3 is a fixing device according to a first embodiment, out of the fixing devices to be installed in the image forming apparatus illustrated in FIGS. 1 and 2.

The fixing device 80 includes an induction heating device 81, a heating belt 82, a pressure roller 83, and an excitation circuit 84. The induction heating device 81 generates an alternating current magnetic field to heat the heating belt 82 by electromagnetic induction. The excitation circuit 84 supplies power generated in the alternating current magnetic field to the induction heating device 81. The heating belt 82 is rotated in the direction indicated by arrow C1 and comes into contact with a sheet of paper, which is holding an unfixed toner image and transported in the direction indicated by arrow D, to heat toner on the sheet of paper.

Here, the induction heating device 81 corresponds to an example of a heating section according to the present disclosure. The heating belt 82 corresponds to an example of a belt according to the present disclosure, and the pressure roller 83 corresponds to an example of a pressure section according to the present disclosure.

In a region enclosed by the heating belt 82, a heating member 821 formed of a magnetic body is disposed on the induction heating device 81 side, and a pressing member 822 is disposed on the pressure roller 83 side. In addition, a supporting structure 823 (an example of a supporting member) that supports the heating member 821 and the pressing member 822 is disposed between the heating member 821 and the pressing member 822. In other words, the supporting structure 823 indirectly supports the heating belt 82 through supporting the pressing member 822.

The heating member 821 induces the alternating current magnetic field generated by the induction heating device 81 and forms a magnetic path, thereby improving efficiency of heating of the heating belt 82 by the induction heating device 81.

The pressing member 822 is positioned on the inner surface of the heating belt 82 so as to be located across the heating belt 82 from the pressure roller 83. The pressing member 822 is a member that presses the heating belt 82 on a pressing surface 822*a* toward the pressure roller 83. The pressing member 822 forms a nip region N while holding the heating belt 82 between the pressing member 822 and the pressure roller 83. A sheet of paper passes through the nip region N while being held between the pressure roller 83 and the heating belt 82. Heat by the heating belt 82 and pressure by the pressure roller 83 are applied to the sheet of paper, and the unfixed toner image is fixed to the sheet of paper.

The supporting structure 823 is structured of a material having high rigidity and maintains uniform pressure in the nip region N (a nip pressure) in the longitudinal direction of the nip region N. The supporting structure 823 is formed of a conductive material. As the conductive material, for example, a metal such as iron, cobalt, nickel, copper, or chromium or a rubber material in which a powdered conductive substance is mixed may be used. The supporting structure 823 is electrically grounded.

The pressure roller 83 is rotated in the direction indicated by arrow C2 by being pushed against the outer surface of the heating belt 82. The pressure roller 83 applies pressure to the sheet of paper that has been transported in the direction indicated by arrow D while holding the sheet of paper between the pressure roller 83 and the heating belt 82. The surface of the pressure roller 83 is an elastic body that deforms to fit the shape of the pressing surface 822*a* of the pressing member 822, when the surface of the pressure roller 83 is pressed.

An excitation coil 811 for induction heating is disposed in the induction heating device 81 with a gap between the excitation coil 811 and the outer peripheral surface of the heating belt 82. The excitation coil 811 is formed by winding a litz wire including bundled wires into a closed-loop shape. The alternating current magnetic field forms around the excitation coil 811 in response to the supply of alternating current from the excitation circuit 84 to the excitation coil 811.

In the induction heating device 81, a magnetic core 812 that forms a magnetic path of the alternating current magnetic field is disposed on an opposite side of the heating belt 82 across the excitation coil 811. The magnetic core 812 is formed of a material having high permeability, such as a ferrite resin. The magnetic core 812 forms a magnetic flux path (equivalent to the magnetic path), in which the magnetic flux of the alternating current magnetic field formed at the excitation coil 811 flows toward the heating member 821 from the excitation coil 811 by traversing the heating belt 82, passes through the inside of the heating member 821, and returns to the excitation coil 811. The magnetic flux of the alternating current magnetic field formed at the excitation coil 811 concentrates in a region of the heating belt 82 opposite the magnetic core 812 as a result of the magnetic core 812 forming the magnetic path.

Figure 4:
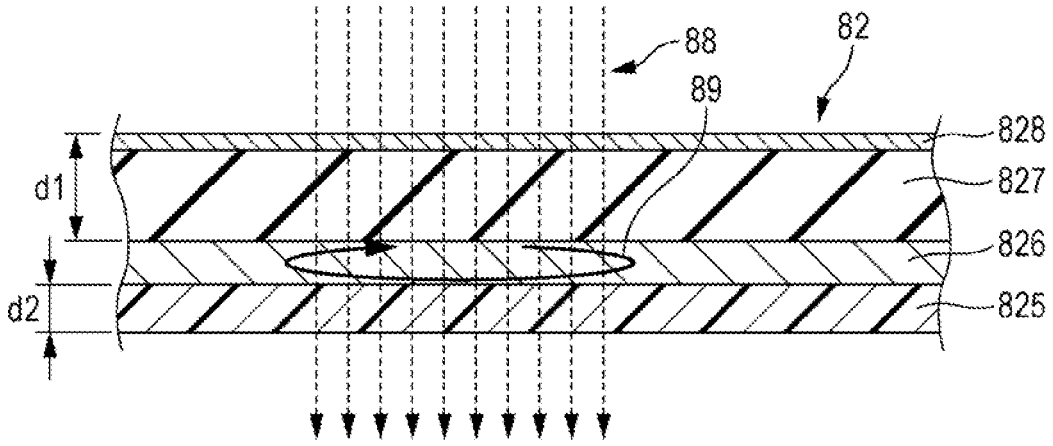
FIG. 4 illustrates a layered structure of a fixing belt and a principle of heat generation by an alternating current magnetic field.

FIG. 4 illustrates a layered structure of a fixing belt and a principle of heat generation by an alternating current magnetic field.

The heating belt 82 is a multilayer belt including a base material layer 825 (an example of a nonmetal layer) formed of a synthetic resin having high heat resistance, such as polyimide or polyether ether ketone, a conductive layer 826 (an example of a metal layer) layered on the base material layer 825, an elastic layer 827 (an example of a nonmetal layer) provided for improving fixability of a toner image, and a surface release layer 828 (an example of a nonmetal layer) forming a top layer and formed of a material having high releasability. The conductive layer 826 is a layer of a heating body that is electromagnetically induction-heated by the alternating current magnetic field formed at the induction heating device 81, and metals such as iron, cobalt, nickel, copper, and chromium are usable for the conductive layer 826.

A magnetic flux 88 of the alternating current magnetic field passes through the heating belt 82. When the magnetic flux 88 passes through the heating belt 82, an eddy current 89 is generated in the conductive layer 826 so as to form a magnetic field that inhibits the change of the alternating current magnetic field. The eddy current 89 flows inside the conductive layer 826, thereby generating joule heat W ($W=I^2R$), where I denotes a current value of the eddy current 89 and R denotes a resistance value of the conductive layer 826, and the heating belt 82 is heated.

The heating member 821 also generates heat due to an eddy current generated by the alternating current magnetic field even though the degree of heat generation is lower than that of the heating belt 82. The temperature of the heating belt 82 is stabilized due to heat generation of the heating member 821.

The surface release layer 828 is formed on the front surface of the heating belt 82, and a toner image on a sheet of paper comes into contact with the surface release layer 828. The toner image is melted and becomes viscous when heated. The surface release layer 828 is a layer for causing the sheet of paper holding the melted toner image to easily peel off from the heating belt 82. Materials such as tetrafluoroethylene-perfluoroalkyl vinyl ether copolymers and fluorinated ethylene propylene-tetrafluoroethylene-hexafluoropropylene copolymers are usable for the surface release layer 828.

A thickness d1 (an example of a first thickness) from the front surface of the heating belt 82 to the conductive layer 826 is larger than a thickness d2 (an example of a second thickness) from the back surface of the heating belt 82 to the conductive layer 826. This is because the thick elastic layer 827 is formed to improve fixability of a toner image even when, for example, a sheet of paper called an embossed sheet, which has an uneven surface, is used. A material such as silicon rubber is used for the elastic layer 827.

A toner image on a sheet of paper that has been transported in the direction indicated by arrow D in FIG. 3 is fixed to the sheet of paper by heating and application of pressure at the fixing device 80. The sheet of paper that has passed through the fixing device 80 is peeled off from the heating belt 82 by a peeling member 87, and the sheet of paper moves in the direction indicated by arrow E. The sheet of paper that has passed through the fixing device 80 is sent out onto the paper output tray 22 illustrated in FIGS. 1 and 2.

Regarding paper used for forming an image, there is acidic component-containing paper such as in some types of envelopes. When acidic component-containing paper is used, there is a possibility of occurrence of electrostatic offset, in which a portion of a toner image is transferred onto the heating belt 82 and appears at an unintended location on a sheet of paper. Such electrostatic offset tends to be caused by the influence of charging of the heating belt 82.

Thus, the fixing device 80 according to the present exemplary embodiment includes a static eliminating member 86 (an example of a first static eliminating section). The static eliminating member 86 is electrically grounded by being fixed to the supporting structure 823 that is electrically grounded. The static eliminating member 86 comes into contact with the back surface of the heating belt 82 to eliminate static from the heating belt 82. The static eliminating member 86 is fixed to the supporting structure 823 with, for example, a metal screw. The metal conductive layer 826 that is embedded in the heating belt 82 is used when the static eliminating member 86 eliminates static from the heating belt 82. That is, electric charge on the heating belt 82 flows inside the conductive layer 826 and further flows through the static eliminating member 86 that is in contact with the back surface of the heating belt 82. Consequently, static of the heating belt 82 is eliminated. The static eliminating member 86 may be a static eliminating brush or a metal plate. That is, the static eliminating member 86 may have any shape and any structure provided that the static eliminating member 86 is configured to come into contact with the heating belt 82 to eliminate static from the heating belt 82, and the specific shape or structure of the static eliminating member 86 does not matter here.

Here, the static eliminating member 86 is not in direct contact with the conductive layer 826, and the base material layer 825 formed of a synthetic resin is interposed between the static eliminating member 86 and the conductive layer 826. The base material layer 825 is, however, thin and allows the electric charge that has accumulated on the heating belt 82 to gradually flow out. The distance between the conductive layer 826 of the heating belt 82 and the static eliminating member 86 may be smaller. As illustrated in FIG. 4, in the present exemplary embodiment, the thickness d2 from the back surface of the heating belt 82 to the conductive layer 826 is smaller than the thickness d1 from the front surface of the heating belt 82 to the conductive layer 826. Thus, in the present exemplary embodiment, the static eliminating member 86 is in contact with the back surface of the heating belt 82 on the side having a smaller thickness out of the front surface side and the back surface side of the heating belt 82. When the thickness from the front surface to the conductive layer 826 is smaller than the thickness from the back surface to the conductive layer 826, unlike the heating belt 82 according to the present exemplary embodiment, the static eliminating member 86 may be in contact with the front surface of the heating belt 82. The above case is a case in which the static eliminating member 86 is in contact with only one of the front surface and the back surface of the heating belt 82; however, the static eliminating member 86 may be in contact with both surfaces of the heating belt 82.

The electric charge that has accumulated on the heating belt 82 flows out through the conductive layer 826. Thus, the static eliminating member 86 may be a static eliminating member that is in contact with only a point or a portion that is outside a region in which a sheet of paper comes into contact with the heating belt 82 and that is a region outside the region in which a sheet of paper comes into contact with the heating belt 82 in the width direction intersecting the paper transport direction. The static eliminating member is in contact with only a point or a portion to address miniaturization of the static eliminating member.

The static eliminating member 86 according to the present exemplary embodiment is in contact with the heating belt 82 at a position closer to an entrance of the nip region N at which the pressure roller 83 presses a sheet of paper against the heating belt 82 than to an exit thereof. Thus, occurrence of electrostatic offset is further effectively suppressed compared with a static eliminating member that eliminates static from the heating belt 82 at a position closer to the exit of the nip region N than to the entrance thereof.

Figure 5:
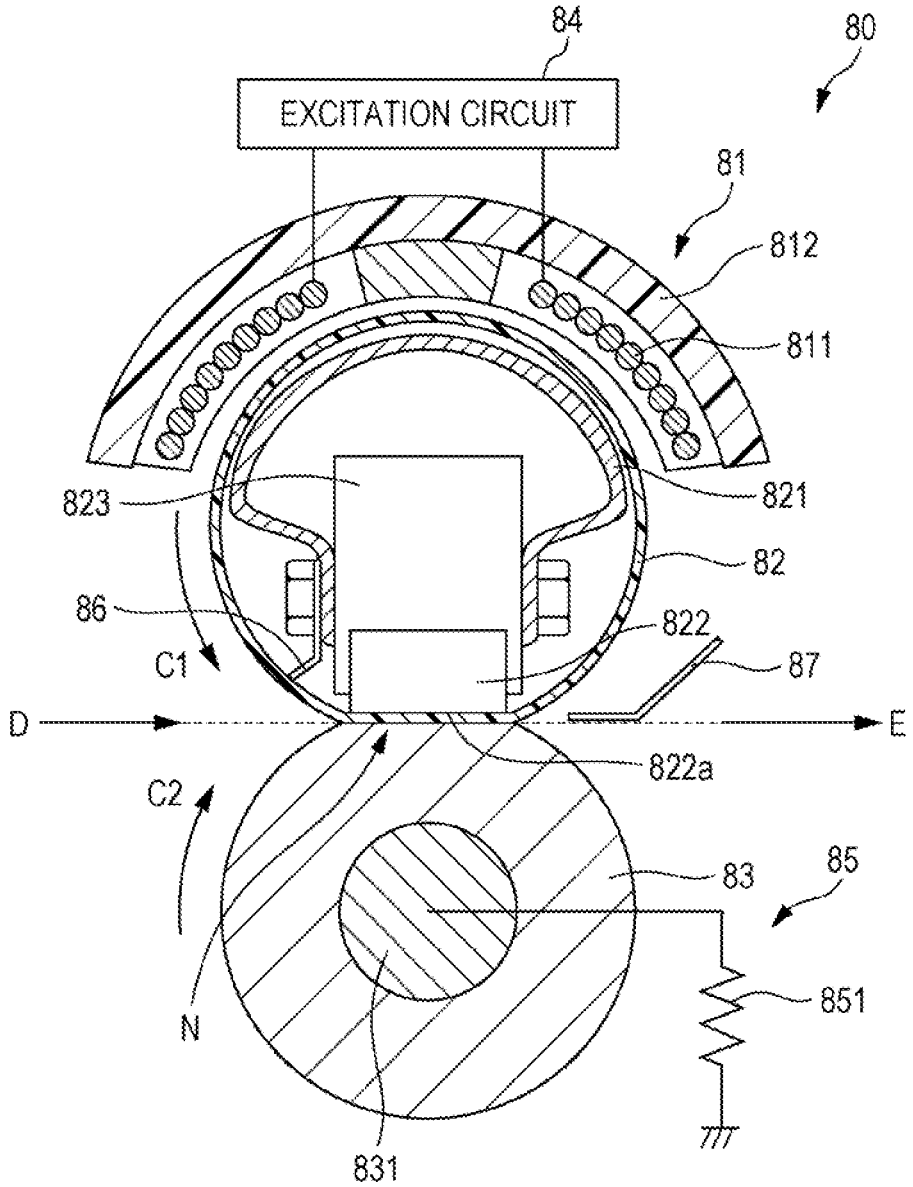
FIG. 5 illustrates a fixing device according to a second exemplary embodiment.

FIG. 5 illustrates a fixing device according to a second exemplary embodiment. Here, components that are the same as those of the fixing device according to the first exemplary embodiment illustrated in FIG. 3 are given the same references as those given in FIG. 3, and only points of difference will be described.

A fixing device 80 illustrated in FIG. 5 includes, in addition to the static eliminating member 86 for eliminating static from the heating belt 82, a static eliminating device 85 (an example of a second static eliminating section) for eliminating static from the pressure roller 83. The static eliminating device 85 grounds a rotation shaft 831 of the pressure roller 83 via a resistor 851 (an example of an element suppressing an electric charge flow). When electric charge has accumulated on the pressure roller 83 and if the electric charge and a toner have the same polarity (here, the toner is electrically charged to have a negative polarity), the toner is pushed toward the heating belt 82 and electrostatic offset of the toner may be promoted. Thus, the static eliminating device 85 for eliminating static from the pressure roller 83 is provided in the second exemplary embodiment. Here, to avoid a sudden change in the potential of the pressure roller 83, the electric charge flow is suppressed by interposing the resistor 851. Alternatively, when the resistance value of the pressure roller 83 is high enough to avoid a sudden change in the potential, or when the pressure roller 83 is made of a material having a sufficiently high resistance value, the rotation shaft 831 of the pressure roller 83 may be directly grounded without the resistor 851.

Figure 6:
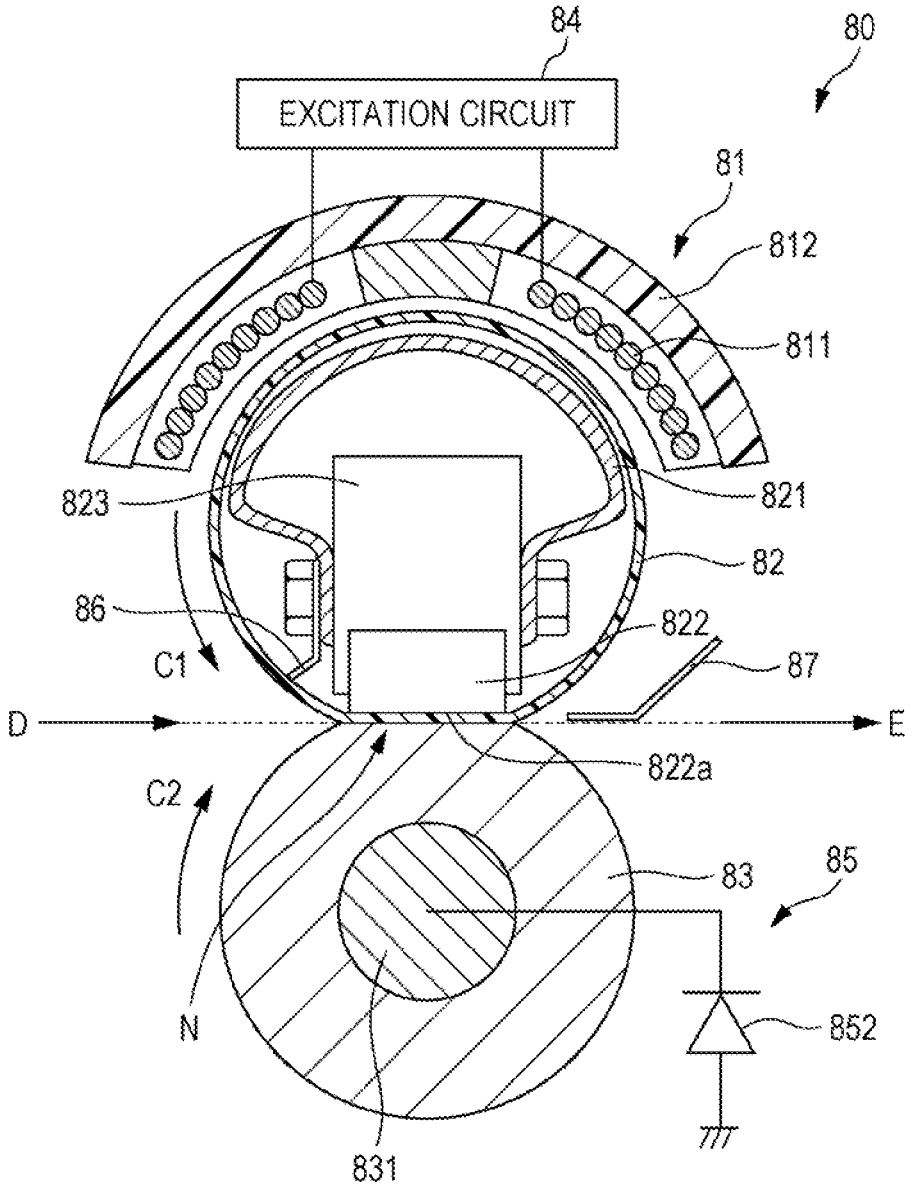
FIG. 6 illustrates a fixing device according to a third exemplary embodiment.

FIG. 6 illustrates a fixing device according to a third exemplary embodiment. As in the second exemplary embodiment, components that are the same as those of the fixing device according to the exemplary embodiment illustrated in FIGS. 3 and 4 are given the same references as those given in FIGS. 3 and 4, and only points of difference will be described.

A fixing device 80 illustrated in FIG. 6 also includes a static eliminating device 85 for eliminating static from the pressure roller 83. However, unlike the static eliminating device 85 illustrated in FIG. 5, the static eliminating device 85 in FIG. 6 grounds the rotation shaft 831 of the pressure roller 83 via a diode 852. As described above, when electric charge having the same polarity as that of a toner has accumulated on the pressure roller 83, the toner is pushed toward the heating belt 82 and electrostatic offset of the toner may be promoted. In contrast, when electric charge having opposite polarity to that of a toner has accumulated on the pressure roller 83, the toner is attracted toward the pressure roller 83, that is, toward a sheet of paper and a particular problem is not caused. Thus, in the third exemplary embodiment, the pressure roller 83 is grounded via the diode 852 so that electric charge having the same polarity as that of a toner does not accumulate on the pressure roller 83.

As illustrated in FIGS. 5 and 6, the static eliminating device 85 for eliminating static from the pressure roller 83 may be provided.

Here, the fixing device 80 that is a type of a fixing device that heats the heating belt 82 by electromagnetic induction is described as an example. However, besides the electromagnetic induction type, it has been considered that a metal layer be embedded in a heating belt, for example, to adjust rigidity of the heating belt. The present disclosure is not limited to the electromagnetic induction type and is applicable to any fixing apparatus provided that the fixing apparatus includes a heating belt including a metal layer.

In addition, the configuration in which the supporting structure 823 indirectly supports the heating belt 82 through supporting the pressing member 822 is described; however, the supporting structure 823 may be in contact with the back surface of the heating belt 82 to support the heating belt 82.

The foregoing description of the exemplary embodiments of the present disclosure has been provided for the purpose of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing apparatus comprising:

a heating section including a belt having a layered structure in which a metal layer is held between nonmetal layers, the belt having a front surface that comes into contact with a toner image and a back surface that does not come into contact with the toner image, the belt having a first thickness from the front surface to the metal layer inside the belt and a second thickness from the back surface to the metal layer inside the belt;

a pressure section that holds, between the pressure section and the belt, a transported sheet of paper holding the toner image and that applies pressure to the sheet of paper; and a first static eliminating section that eliminates static from the belt while being in contact with a surface of the belt, the surface being the front surface or the back surface that is on a side of the first thickness or the second thickness having a smaller thickness when the first thickness and the second thickness are compared.

2. The fixing apparatus according to claim 1, wherein the belt is a belt in which the second thickness is smaller than the first thickness, and wherein the first static eliminating section is disposed closer to the back surface than to the front surface.

3. The fixing apparatus according to claim 2, wherein the belt includes an elastic layer that is positioned closer than the metal layer to the front surface.

4. The fixing apparatus according to claim 2, wherein the heating section includes a supporting member that is conductive and grounded, the supporting member being disposed closer to the back surface than to the front surface to support the belt, and wherein the first static eliminating section is electrically connected to the supporting member.

5. The fixing apparatus according to claim 3, wherein the heating section includes a supporting member that is conductive and grounded, the supporting member being disposed closer to the back surface than to the front surface to support the belt, and wherein the first static eliminating section is electrically connected to the supporting member.

6. The fixing apparatus according to claim 1, wherein the first static eliminating section eliminates static from the belt at a position closer to an entrance of a nip region at which the pressure section presses a sheet of paper against the belt than to an exit of the nip region.

7. The fixing apparatus according to claim 2, wherein the first static eliminating section eliminates static from the belt at a position closer to an entrance of a nip region at which the pressure section presses a sheet of paper against the belt than to an exit of the nip region.

8. The fixing apparatus according to claim 3, wherein the first static eliminating section eliminates static from the belt at a position closer to an entrance of a nip region at which the pressure section presses a sheet of paper against the belt than to an exit of the nip region.

9. The fixing apparatus according to claim 4, wherein the first static eliminating section eliminates static from the belt at a position closer to an entrance of a nip region at which the pressure section presses a sheet of paper against the belt than to an exit of the nip region.

10. The fixing apparatus according to claim 5, wherein the first static eliminating section eliminates static from the belt at a position closer to an entrance of a nip region at which the pressure section presses a sheet of paper against the belt than to an exit of the nip region.

11. The fixing apparatus according to claim 1, further comprising:

a second static eliminating section that eliminates static from the pressure section.

12. The fixing apparatus according to claim 2, further comprising:

a second static eliminating section that eliminates static from the pressure section.

13. The fixing apparatus according to claim 3, further comprising:

a second static eliminating section that eliminates static from the pressure section.

14. The fixing apparatus according to claim 4, further comprising:

a second static eliminating section that eliminates static from the pressure section.

15. The fixing apparatus according to claim 5, further comprising:

a second static eliminating section that eliminates static from the pressure section.

16. The fixing apparatus according to claim 6, further comprising:

a second static eliminating section that eliminates static from the pressure section.

17. The fixing apparatus according to claim 7, further comprising:

a second static eliminating section that eliminates static from the pressure section.

18. The fixing apparatus according to claim 11, wherein the second static eliminating section is a static eliminating section in which an electric charge flow is suppressed, compared with the first static eliminating section.

19. The fixing apparatus according to claim 18, wherein the second static eliminating section is grounded via an element that suppresses an electric charge flow.

20. An image forming apparatus comprising:

an image forming section that forms a toner image on a sheet of paper, and the fixing apparatus according to claim 1.

* * * * *